US006895847B2

(12) United States Patent
Müller

(10) Patent No.: US 6,895,847 B2
(45) Date of Patent: May 24, 2005

(54) THREE KNIFE TRIMMER

(75) Inventor: Hans Müller, Zofingen (CH)

(73) Assignee: Müller Martini Holding AG, Hergiswil (CH)

( * ) Notice: Subject to any disclaimer, the term of this patent is extended or adjusted under 35 U.S.C. 154(b) by 0 days.

(21) Appl. No.: 10/147,161

(22) Filed: May 16, 2002

(65) Prior Publication Data

US 2002/0170405 A1 Nov. 21, 2002

(30) Foreign Application Priority Data

May 21, 2001 (EP) ..... 01810505

(51) Int. Cl.[7] ..... B26D 5/22

(52) U.S. Cl. ..... 83/618; 83/311; 83/343; 83/555; 83/602; 83/628; 83/934

(58) Field of Search ..... 83/620, 628, 602, 83/934, 300, 320, 311, 343, 598, 618, 555

(56) References Cited

U.S. PATENT DOCUMENTS

| | | | |
|---|---|---|---|
| 3,800,647 | A | 4/1974 | Morse et al. |
| 3,918,336 | A | 11/1975 | Macey et al. |

FOREIGN PATENT DOCUMENTS

| | | |
|---|---|---|
| CH | 537260 | 7/1973 |
| DE | 3201836 | 9/1983 |
| DE | 4009911 | 10/1990 |

*Primary Examiner*—Charles Good
(74) *Attorney, Agent, or Firm*—Friedrich Kueffner

(57) ABSTRACT

A three knife trimmer has a front knife and two lateral knives. A drive device drives the front knife and the two lateral knives such that a front cut and at least one lateral cut are performed with phase displacement by the front knife and at least one of the two lateral knives on the material to be cut. The drive device has at least one drive curve. At least two pivotable levers engage the drive curve, wherein the front knife and at least one of the two lateral knives are drivingly connected to the at least two pivotable levers.

5 Claims, 2 Drawing Sheets

THREE KNIFE TRIMMER

BACKGROUND OF THE INVENTION

1. Field of the Invention

The invention relates to a three knife trimmer, comprising a front knife and two lateral knives which are driven by a drive device such that they perform on a material to be trimmed a front cut and at least one lateral cut with phase displacement.

2. Description of the Related Art

Three knife trimmers for cutting or trimming three sides of printed products, for example, books, brochures and the like, have been known in the art for some time. For carrying out the cutting process, the material to be cut is conveyed onto a cutting table, aligned on the cutting table underneath the knives, and secured by a pressing plate or the like on the cutting table. By means of the two lateral knives the top and bottom sides of the material are cut at the same time. Prior to this, or subsequent thereto, the front side is cut by the front knife in an additional working step. The trimmed material is moved automatically out of the cutting area and is guided away from the three knife trimmer, for example, by means of a conveyor belt. In these three knife cutting machines or trimmers, the cuts are thus always performed in a single cutting station. Since the material to be cut must be aligned only once, significant advantages result relative to three knife cutting machines with two cutting stations. In order for the front and lateral knives not to collide, the front cut and the lateral cuts are performed with phase displacement.

A three knife trimmer or cutting machine of the aforementioned kind is, for example, known from German patent application 32 01 836. It has a drive device for the knives which comprises a so-called guide gear unit and a so-called operational gear unit upstream thereof. The operational gear unit is formed by a gear wheel unit with a gear ratio which changes during one revolution of a single revolution shaft. A further three knife cutting machine is described in Swiss patent application 537 260. Here, the drive for the knives is realized by a driven single revolution shaft supported within the machine body. On the ends of the single revolution shaft a crank is arranged, respectively, having crank pins which engage a connecting rod, respectively. For driving the front blade a universal joint rod is also provided which is said to make possible a replacement of the conventional two-sided knife pull by a single-sided knife pull. These three knife trimmers are comparatively complex with respect to their configuration and, in particular, the configuration of the drive.

SUMMARY OF THE INVENTION

It is an object of the present invention to provide a three knife trimmer or cutting machine of the aforementioned kind which has a simpler configuration with fewer parts but still provides functional reliability.

In accordance with the present invention, this is achieved in that the drive device has at least one drive curve engaged by at least two pivotable levers with which the front knife and at least one lateral knife are drivingly connected.

The drive of the two levers by means of a single drive curve makes possible a simple configuration with few parts as well as a deformation-resistant movement.

In the three knife cutting machine according to the invention the drive curve is endless. This curve moves at least two pivotable levers with which the front knife and at least one lateral knife are driven. The drive of the knives is realized thus by a single curve. The design of this curve can determine the non-uniform movement of the knives. The drive with the common drive curve results in a phase-displaced movement of the knife carrier. Since the drive device can be configured with few and robust individual parts, a deformation-resistant movement of the knives or the knife carriers is realized also.

The drive curve is, for example, driven by a pinion and moves at the same time at least two levers with which the front knife and at least one side blade can be driven. For a two-sided blade pull a second drive curve can be provided which is connected with the first drive curve by means of a torsion-proof shaft.

The lever for the front knife is preferably a linkage which engages a knife coupler. The two lateral knives are preferably fastened at a spacing to one another on a carrier shaft which is drivingly connected with at least one of the aforementioned levers for carrying out the cutting movements. More advantages can be taken from the dependent claims as well as the following description and the drawing.

DESCRIPTION OF THE PREFERRED EMBODIMENTS

Figure 1:
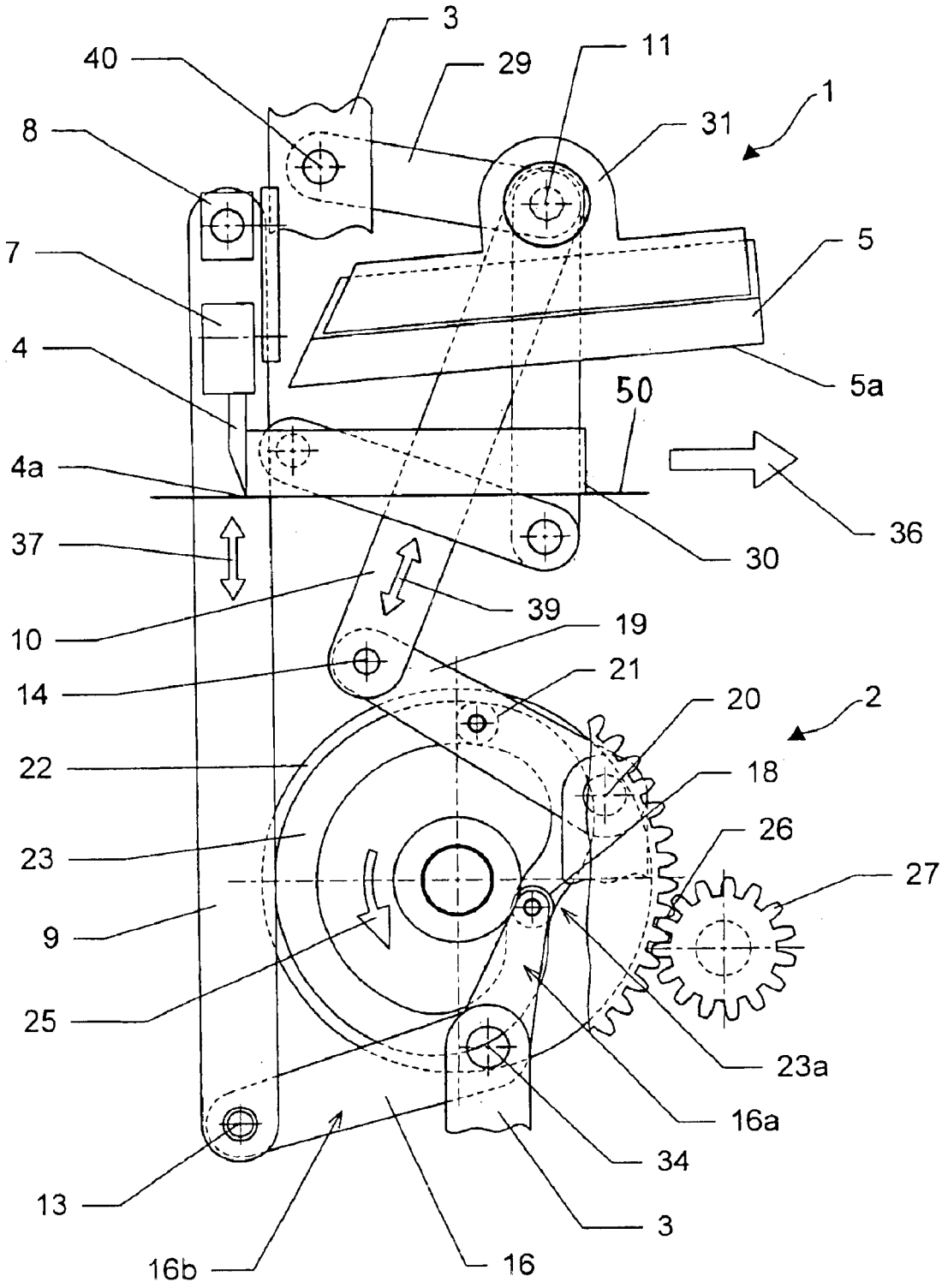
FIG. 1 shows schematically a side view of a three knife trimmer according to the invention.

The three knife cutting machine or trimmer 1 has a front knife 4 as well as two lateral knives 5, 6 which are driven by a drive device 2 non-uniformly and with phase displacement. Preferably, the front cut is carried out before the lateral cut(s). The cutting sequence is however reversible in a simple way by a rotational direction change of the shaft 24.

Figure 2:
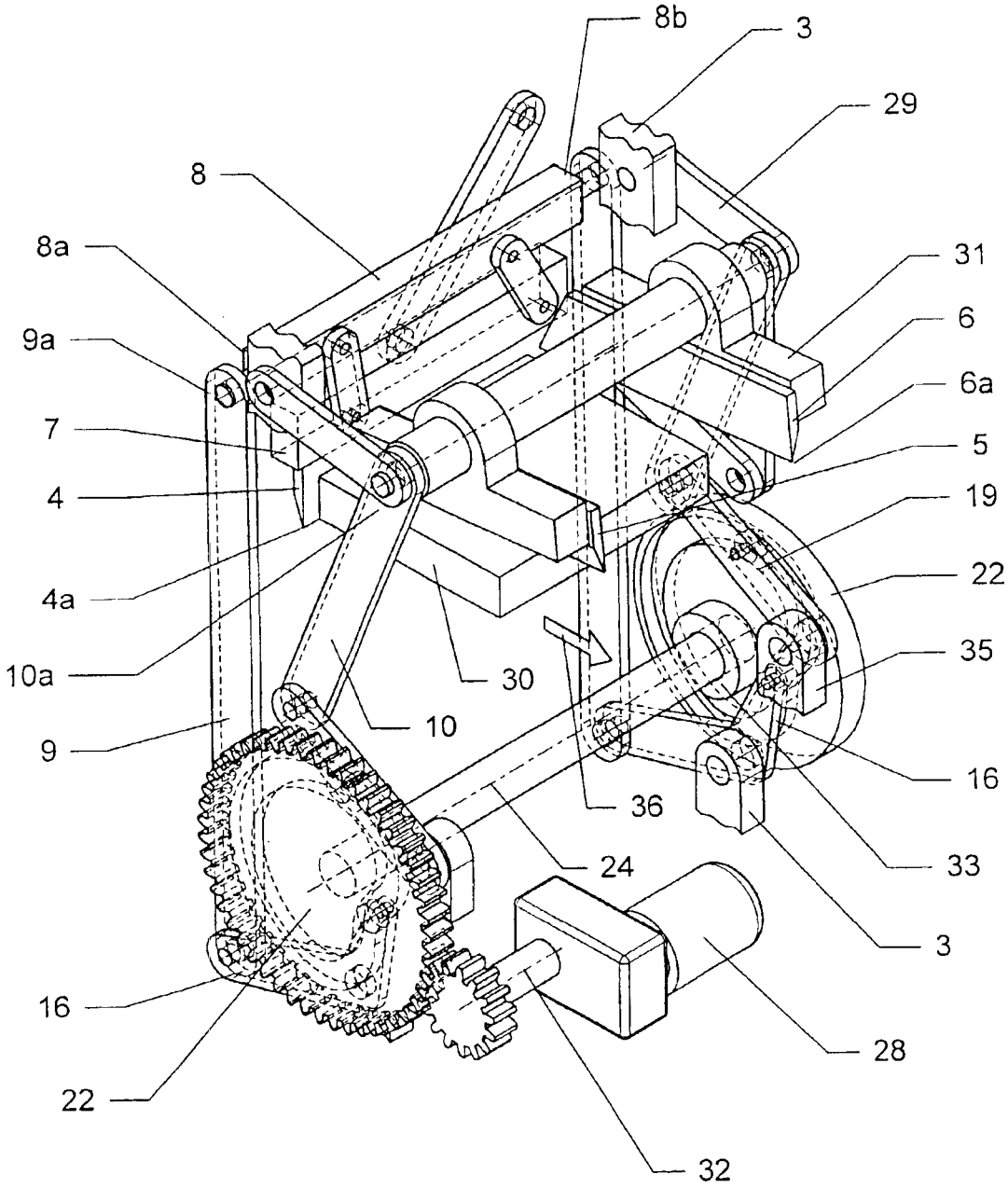
FIG. 2 shows schematically a perspective view of the three knife trimmer according to the invention shown in FIG. 1.

In FIG. 2, the shaft 24 connects first and seconds cams disk 22, 22' with one another. The disk cam 22' has a hub 33.

The two lateral knives 5 and 6 are arranged by means of a carrier 31 on the carrier shaft 11, respectively. The spacing of these two knives 5 and 6 relative to one another can be adjusted by movement of the two carriers 31 for adjustment to the size of the material 30 to be cut. The two knives 5 and 6 are arranged parallel to one another and have each a cutting edge 5*a*, 6*a*. By means of two pivotable stays 29 arranged at a spacing to one another, the support shaft 11 is fastened on a machine frame 3, which is indicated only schematically in FIG. 1, such that the cutting knives 5 and 6 are essentially vertically movable for performing the cutting movements. The material 30 to be cut, which is, for example, a stack of printed products, is supplied in the direction of arrow 36 (FIG. 2) to the cutting table 50. The cut material is carried in the same direction away from the three knife cutting machine 1.

According to FIG. 1, the front knife 4 has a cutting edge 4*a*. The knife 4 illustrated in FIGS. 1 and 2 is fastened on a blade carrier 7 connected to a coupler 8 having ends 8*a*, 8*b*. A linkage 9 is pivotably connected with its upper end 9*a* to the end 8*a* of the coupler 8. Moreover, the coupler 8 is guided on the machine frame 3.

According to FIG. 1, the linkage 9 is vertically moveably arranged as shown by the double arrow 37. For this purpose, the lower end of the linkage 9 is connected by a joint 13 with a lever 16 which engages with a cam roller 18 the drive curve 23 of a disk cam 22. The lever 16, as illustrated, is a two-arm angle lever which is pivotably supported by means of a bearing 34 on the machine frame 3 between the joint 13 and the cam roller 18. The arm 16*a* of the lever 16 on which the cam roller 18 is arranged is significantly shorter than the arm 16*b* to which the linkage 9 is connected.

The disk cam 22 is preferably driven by a motor 28 which engages via drive shaft 32 by means of a pinion 27 a toothing 26 of the disk cam 22. The disk cam 22 is driven counter-clockwise as indicated by the arrow 25. By changing the rotational direction so that the disk cam 22 rotates in the clockwise direction, the cutting sequence can be reversed. In the first case, first the front cut and subsequently the lateral cuts are performed. In the second case, first the lateral cuts and subsequently the front cut are carried out.

By means of the drive curve 23 the second lever 19 is moved at the same time. The second lever 19 is a single arm lever and is supported with one end pivotably about an axis 20 on a bearing 35 (FIG. 2) connected to the frame. At the other end of the lever 19 a rotary joint 14 is arranged which connects the lever 19 with a rod 10 which, in turn, is connected with its upper end 10*a* rotatably with the carrier shaft 11. Between the axis 20 and the joint 14, a cam roller 21 is arranged on the lever 19 which engages the drive curve 23. The drive curve 23 can be formed as a closed curve or as an open curve. Preferably, the drive curve 23 is a closed curve with which comparatively great cutting forces can be received. In principle, an open curve with spring or complementary curve is also conceivable. The rod 10 carries out movements according to double arrow 39 when the disk cam 22 is driven. Accordingly, the stays 29 are pivoted about the axis 40 fixedly provided on the frame.

It is important that the linkage 9 as well as the rod 10 are driven by the same drive curve 23. The drive curve 23 is continuously circulating and designed such that the linkage 9 as well as the rod 10 are moved with phase displacement. The pivot movements of the levers 16 and 19 occurs when the cam roller 18 and 21 move into a recessed area 23*a*, respectively. When the disk cam 22 is rotated in the direction of arrow 25, first the lever 16 and subsequently the lever 19 are pivoted in FIG. 1. Correspondingly, first the cut with the front knife 4 and subsequently the cuts with the lateral knives 5 and 6 are performed.

Once the front cut and the lateral cuts have been performed, the cut material 30 must be moved away from the machine 1 and at the same time the next material to be cut must be supplied to the cutting table and must be fixed in position thereon. The working cycle time available must be utilized for aligning the material 30, cutting it, and transporting it away. Upon transporting the cut material 30 away from cutting table, the front knife 4 and the two lateral knives 5 and 6 must be in a position in which the aforementioned transport is made possible. This can be achieved with a corresponding configuration of the drive curve 23. In particular, the knives 4, 5, and 6 can be accelerated or decelerated by a corresponding configuration of the drive curve 23 in such a way that the working cycle time available for the transport is optimal.

While specific embodiments of the invention have been shown and described in detail to illustrate the inventive principles, it will be understood that the invention may be embodied otherwise without departing from such principles.

What is claimed is:

1. A three knife trimmer for three-sided cutting of printed products on a cutting table, the trimmer comprising:

a front knife and two lateral knives;

a drive device configured to drive the front knife and the two lateral knives such that a front cut and at least one lateral cut are performed with phase displacement by the front knife and at least one of the two lateral knives on the material to be cut;

wherein the drive device has at least one drive curve;

at least two pivotable levers engaging the drive curve, wherein the front knife and at least one of the two lateral knives are drivingly connected to the at least two pivotable levers.

2. The machine according to claim 1, wherein the drive curve is endless.

3. The machine according to claim 1, wherein the two lateral knives are positioned at a spacing to one another, wherein a first one of the two pivotable levers has a carrier shaft, and wherein the two lateral knives are arranged on the carrier shaft.

4. The machine according to claim 3, further comprising a linkage connected to a second one of the two pivotable levers, wherein the front knife is fastened on the linkage.

5. The machine according to claim 1, wherein the drive device has two of the drive curves and further comprises a torsion-proof shaft, wherein the two drive curves are arranged at a spacing relative to one another and are connected to one another by the torsion-proof shaft.

* * * * *